United States Patent [19]

Karpisek

[11] Patent Number: 4,763,461

[45] Date of Patent: Aug. 16, 1988

[54] METHOD AND APPARATUS FOR STRETCH WRAPPING

[76] Inventor: Ladislav S. Karpisek, 86 Woodfield Boulevarde, Caringbah, New South Wales 2229, Australia

[21] Appl. No.: 3,408

[22] PCT Filed: Mar. 21, 1986

[86] PCT No.: PCT/AU86/00075

§ 371 Date: Dec. 10, 1986

§ 102(e) Date: Dec. 10, 1986

[87] PCT Pub. No.: WO86/05761

PCT Pub. Date: Oct. 9, 1986

[30] Foreign Application Priority Data

Mar. 21, 1985 [AU] Australia ..... 55033/86
Mar. 27, 1985 [AU] Australia ..... PG9920

[51] Int. Cl.[4] ..... B65B 9/13; B65B 13/02

[52] U.S. Cl. ..... 53/399; 53/441; 53/556; 53/567; 53/585

[58] Field of Search ..... 53/399, 441, 556, 567, 53/585

[56] References Cited

U.S. PATENT DOCUMENTS

| | | | |
|---|---|---|---|
| 181,052 | 8/1876 | De Gray | 53/399 |
| 2,026,284 | 12/1935 | Metternich | 53/585 X |
| 3,089,298 | 5/1963 | Nevendurf | 53/373 |
| 3,495,375 | 2/1970 | Burhop | 53/441 X |
| 3,621,638 | 11/1971 | Grocke | 53/567 X |
| 4,605,456 | 8/1986 | Annis | 53/399 X |

FOREIGN PATENT DOCUMENTS

| | | | |
|---|---|---|---|
| 2945551 | 6/1981 | Fed. Rep. of Germany | 53/556 |

*Primary Examiner*—John Sipos

[57] ABSTRACT

An apparatus for wrapping a load by placing, under tension, as panel of elastically stretchable sheet material around the load and including a base (2) having a load positioning recess or notch (3) and a tensioning bar (4) which is movably mounted on the base to grip the surplus of a single wrap of material around the load and to place the wrap under tension, and heat sealing bars (7) located between the load positioning recess or notch (3) and the tensioning bar (4) to secure the material drawn there-through. Other devices to secure the material are also disclosed.

8 Claims, 4 Drawing Sheets

METHOD AND APPARATUS FOR STRETCH WRAPPING

Figure 1:
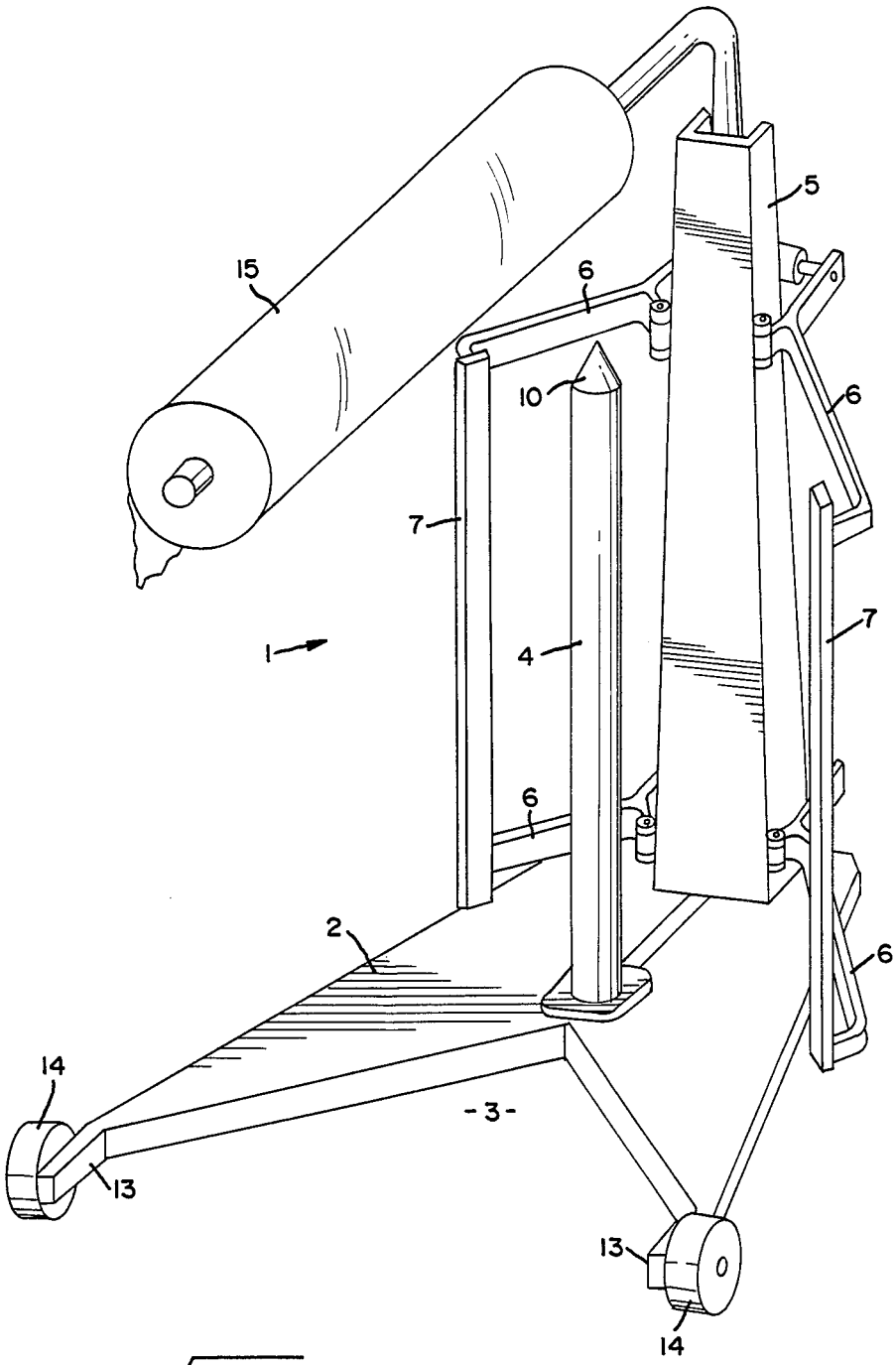

This invention provides a method and appratus for the wrapping of an article or an assembly of articles.

In the past there has been three common ways of wrapping an article or an assembly of articles with plastic film material. In one method (shrink wrapping) a plastic film bag (or sleeve) a little larger than the load to be wrapped is placed over the load, e.g. an assembly of boxes on a pallet, and then heat is applied to the bag and it shrinks onto the load. This method relies on the plastic bag being stretched and "frozen" in the stretched state at manufacture and the "unfreezing" of plastic bag by heat to allow the plastic bag to contract towards its normal unstretched state, which is smaller than the load. As the unstretched state cannot be attained the plastic bag forms a tensioned wrap around the load.

In a second method (stretch-and-shrink) a bag (or sleeve) of plastic film smaller in cross-section than the load is formed as a puckered band on a frame, the frame is expanded to stretch the puckered band and then the bag is stripped from the frame onto the load. The plastic bag when released from the stretching forces contracts and becomes an elastically embracing wrap around the load.

In the third method (stretch wrapping) a continuous band of stretchable plastic film under tension is wrapped around and around the load like a bandage.

All of the above wrapping methods have goods features and all have disadvantages. In the case of shrink wrapping the advantage is that the equipment needed, namely, a plastic bag and a heat gun or oven, is comparatively inexpensive. The disadvantage is that heat has to be used and and the heat can cause holes in the plastic and can effect goods being wrapped. Another disadvantage occurs where the goods to be wrapped as a bulk quantity are individually wrapped in a material which will stick to the outer wrap due to the use of heat in the wrapping process.

In stretch-and-shrink, the advantages are lack of heat, a very firm wrap around the load, an end cover over the top of the load simultaneously with the wrapping of the load and a substantially mechanised wrap procedure which is quick and efficient. For many applications this form of wrapping is ideal. The disadvantages are that the equipment is in the form of a machine that is reasonably complex and therefore the capital outlay for the machine is a consideration. The loads have to be brought to the machine and substantial space is required for the machine and the performance of the wrapping operation. This method is however without equal in factories where the wrapping of pallet loads is a continuous and substantially mechanised operation. In stretch wrapping the major disadvantages are that the equipment is expensive, it occupies substantial floor space and requires load holding devices to be used whilst the wrapping is performed. Because the method is a true "wrapping" technique there is likely to be an overuse of the wrap material because of the need for operator control. Additionally, there is no automatic way to obtain a top cover over the load as part of the wrapping operation, as is possible with the use of bags in the stretch-and-shrink and the shrink only methods.

The present invention overcomes most of the above disadvantages. It is a no-heat procedure and it can use a sleeve or a bag made of any plastic film material that will allow a limited amount of elastic stretch, substantially all plastic film has this quality. The equipment required to perform the wrapping method is economical to make and easy to service and can be mobile so that it can be taken to the load to be wrapped, whereas with known no-heat wrapping methods the loads to be wrapped have to be taken by a fork lift truck or the like to a wrapping machine in a specific location.

Accordingly, the present invention can be said to provide broadly, a method of wrapping an article or a group of articles hereinafter called a load, by the steps of placing around the load a panel of elastically stretchable sheet material having a length greater than the circumferential length of the load and to thereby provide a surplus of said material, accumulating said surplus material and applying a force to said surplus material to draw the material around the load into tightly embracing engagement therewith, forming adjacent said load a securement between the portions of the said panel extending from the load to the said accumulation so that when said force is released the tightness of the embrace of said load by said panel remains substantially undiminished.

The invention further provides apparatus to wrap an article or a group of articles objects, hereinafter called a load, in elastically stretchable sheet material, said apparatus comprising a base, a load positioning means on said base, a tensioning means mounted on said base so as to be movable relative thereto and adapted to grip wrapping material surplus to a single pass around a load, and securement apparatus mounted on said base between the load positioning means and the tensioning means and movable between an inoperative position allowing surplus wrapping material gripped by said tensioning means to be drawn therethrough and an operative position to secure together wrapping material therein.

Figure 2:
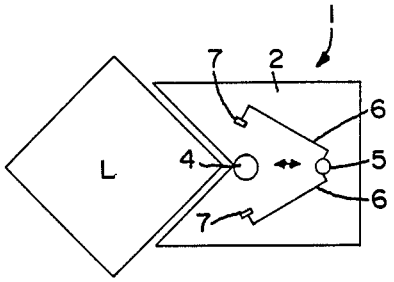
Figure 3:
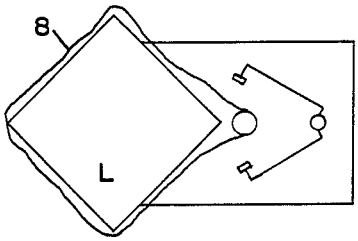
Figure 4:
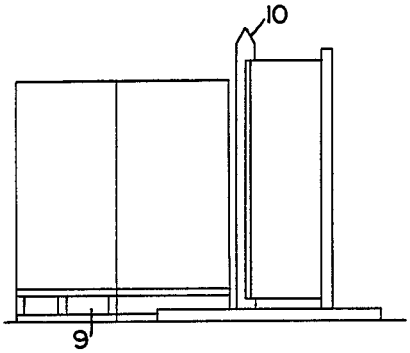
Figure 5:
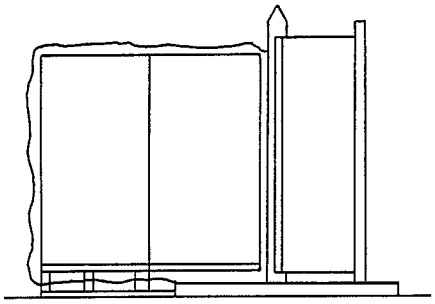
Figure 6:
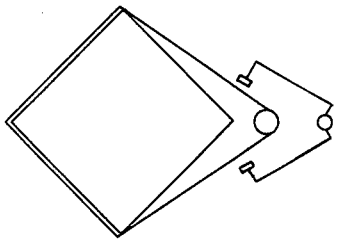
Figure 7:
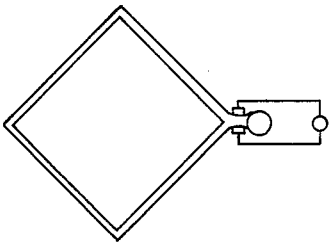
Figure 8:
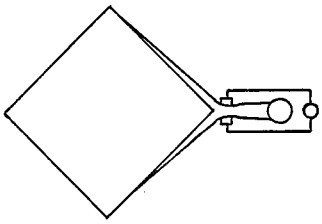
Figure 9:
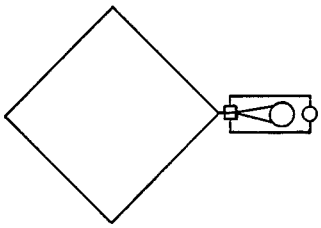
Figure 10:
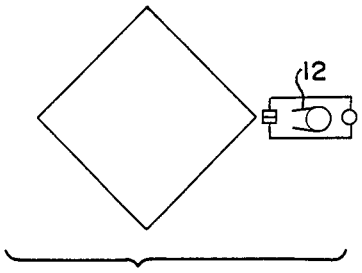
Figure 11:
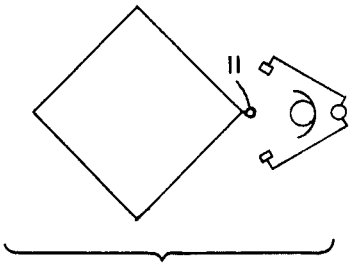
Figure 12:
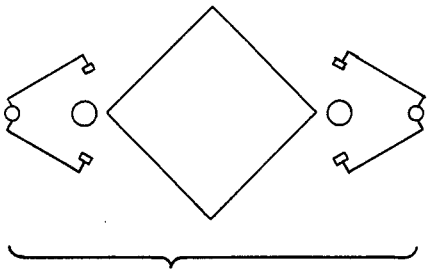
Figure 13:
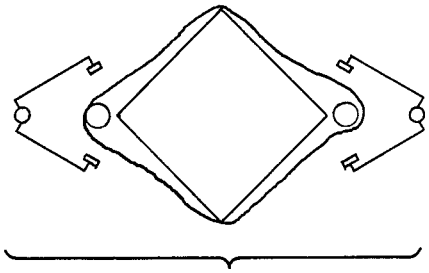
Figure 14:
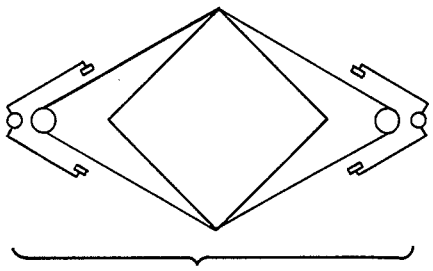
Figure 15:
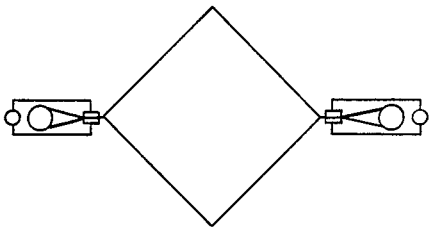
Figure 16:
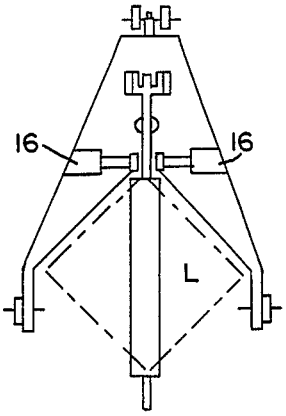
Figure 17:
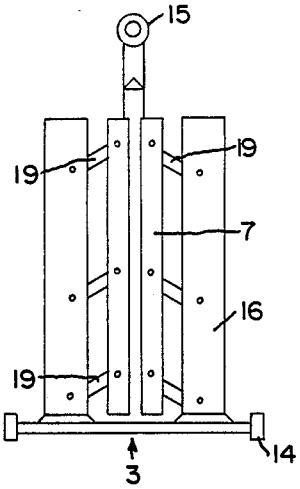
Figure 18:
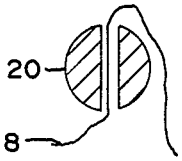
Figure 19:
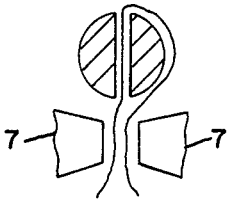
Figure 20:
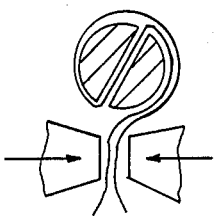

Several presently preferred forms of the method and apparatus of the invention will now be described with reference to the accompanying drawings in which:

FIG. 1 is a perspective view of one form of a wrapping machine according to the invention, FIG. 2 is a diagrammatic plan view of the machine of FIG. 1, FIG. 3 is a view similar to FIG. 2 showing a load with a wrapping bag loosely disposed therearound, FIG. 4 is a side elevation of the arrangement of FIG. 2, FIG. 5 is a side elevation of the arrangement of FIG. 3, FIG. 6 illustrates the first step in the wrapping procedure using the apparatus as shown in FIG. 2, FIG. 7 illustrates a further preliminary step in the wrapping procedure, FIG. 8 illustrates the stretching step of the wrapping procedure, FIG. 9 illustrates the sealing step in the wrapping procedure, FIG. 10 illustrates the severance step in the wrapping procedure, FIG. 11 illustrates the final step in the wrapping procedure, FIG. 12 illustrates a duplex arrangement for a wrapping procedure, FIG. 13 illustrates the placement of a bag over a load in readiness for the use of the duplex arrangement, FIG. 14 illustrates the stretch step, FIG. 15 illustrates the seal and sever step using the duplex arrangement, FIG. 16 is a schematic top view of apparatus similar to the FIG. 1 apparatus but incorporating a different type of sealing means support, FIG. 17 is a front view of the FIG. 16 apparatus, FIG. 18 shows one way for engaging the plastic bag in a stretch force applying means, FIG. 19 shows a second step in the use of the FIG. 18 device, and FIG. 20 shows a further step in the use of the FIG. 18 device.

The machine shown in FIG. 1 is to be considered as illustrative of a prototype form of the machine proposed for the performance of the inventive method. The details of the machine will become apparant from the following description of the method to be performed with the machine.

Referring to FIG. 2 there is shown a rectangular load L and a stretch/seal machine 1 which may be of the type shown in FIG. 1 or FIGS. 16 and 17 or of any other type that will allow the inventive method to be performed. The machine proposed comprises a base 2 with a front notched at 3 to receive the corner of the load L. There is a tensioning bar 4 and a mast 5 upstanding from the base 2. Arms 6 are pivotally mounted on the mast 5. The arms 6 carry sealing bars 7. The tensioning bar 4 is movable towards and away from the mast 5 as indicated by the arrow. Plan view FIG. 3 shows a plastic film sleeve or bag 8 larger than the load L draped around and over the load L and around the tensioning bar 4. FIGS. 4 and 5 are side views of the components shown in FIGS. 2 and 3 respectively and it will be seen that the load L is supported on a pallet 9 and it is a corner of the pallet 9 that is housed in the notch 3 of the base 2, and that the tensioning bar 4 has a pointed top 10. In order that the end of the bag 8 can be lowered onto the top of the load L, with the tensioning bar 4 within the bag, it is necessary to pierce the end of the bag 8 and the pointed top 10 of the tensioning bar 4 is provided for this purpose.

It will be noted that the height of the members 4,5 and 7 is greater than the height of the load. The device proposed will have an optimum height which will approximate but be greater than the tallest load likely to be used with the device. In practice the height of loads on pallets seldom exceeds two metres and the height of the members 4,5 and 7 can be assumed for most purposes to have a height in the same order. The number of arms 6 needed to support the sealing bars 7 would be appropriate to the length of the sealing bars 7. FIGS. 6 to 11 show the steps of wrapping the load L according to the presently preferred method. First by means of an approriate mechanism, for example a threaded member rotatably mounted in the base 2 is engaged in a nut on the lower end of the member 4 which is slidable in a track in the base 3, the tensioning bar 4 is moved towards the mast 5 to take up the slack in the bag 8 and induce a small amount of stretch in the bag walls, see FIG. 6. Then by means of an appropriate mechanism, for example air cylinders illustrated as connecting extensions of the arms 6 in FIG. 1; the arms 6 are pivoted on the mast 5 to bring the as yet unheated sealing bars 7 together to the relative position shown in FIG. 7.

FIG. 8 shows the tensioning of the bag by further movement of the tensioning bar 4 towards to the mast 5. A considerable stretch of the plastic can thus be achieved to provide a tight elastically embracing protective plastic film cover for the load. The sealing bars 7 serve to maintain the portions of the plastic film to be secured together in close proximity to each other ready for the sealing step. The sealing bars 7 can also act as abutments to prevent the movement of the load on the pallet as the bag is tensioned and the plastic is stretched.

FIG. 9 is a plan view showing the sealing step in which the bars 7 are brought together and power is momentarily applied to an electrically heated element in one of the members 7 to heat seal the two panels of plastic together.

In an alternate program the stretch step as illustrated in FIG. 6 is continued until the desired stretch is applied to the plastic and then the step of FIG. 9 is performed thereby eliminating the steps of FIGS. 7 and 8.

FIGS. 10 and 11 are plan views showing the severance of the waste plastic 12 from the load wrapping plastic and the release of the seal 11 by the sealing bars 7. The severance of the waste plastic can be achieved in many ways as for example by the operator using a knife, preferably however the sealing bars 7 incorporate a knife or other means to achieve waste severance rearwardly of the seal 11 subsequent to the formation of the seal 11.

FIGS. 12 to 15 sequentially illustrate the wrapping steps of FIGS. 2 to 11 when performed by two devices of the type described with reference to FIGS. 2 to 11. This arrangement provides a balanced condition for the stretching forces applied during the plastic tensioning step. As will be understood the wrapping, tensioning and sealing operations of the two devices illustrated can be co-ordinated by two operatives or by means of appropriate mechanical control means. Likewise the operations of the single device to perform the steps of FIGS. 2 to 11 can be ope invention, for use in the manner disclosed in FIGS. 12 to 17, when associated with a conveyor on which loaded pallets, or other loads or assemblies of articles are conveyed. The conveyor would be intermittently moved to allow time for the wrapping operation. The movement of the conveyor and operational sequences of the devices can be centrally controlled in a semi or substantillets are dispatched.

Referring now specifically to FIG. 1, which illustrates a prototype machine used for development of the wrapping method disclosed above. The load positioning notch 3 terminates in two arms 13 each provided with a wheel 14 to allow the machine to be moved from place to place to wrap loaded pallets "on site" at the locations where the pallet loading has taken place. This feature eliminates the need for handling of the loaded pallets at the wrapping stage by a fork lift truck. The advantages of this are at once obvious at this is one of the drawbacks with the presently known "stretch" and "stretch-and-shrink" techniques. The mast 5 supports a holder for a supply roll of plastic film 15 in sleeve or bag form. If the load is supported above the ground, as for example on a low stand smaller in size than the pallet, the plastic wrap can engage under the pallet to bind the load to the pallet.

Possible ways in which several of the functions of the proposed machine can be carried out will now be described. For example, the arms 6 of swingable type can be replaced by two uprights 16, see FIGS. 16 and 17, connected through links 19 to the sealing bars 7 so that by means of a parallel link motion the bars 7 move orthogonally with respect to the direction of plastic stretch.

As an alternative to the sealing bars 7 stapling or clip applying means may be provided to achieve the fastening of the bag sides together to maintain the plastic in tight embrace around the load L. The movement of the bars 7 can be achieved either through a manually actuated linkage or by power means. Irrespective of the sealing means used the sequence of operations will be substantially as described above with reference to the FIGS. 2 to 11.

Other aspects of the invention such as the movement of the tensioning bar 4 is a matter of mechanical design and any suitable arrangement may be employed, such as, for example, the provision of a threaded member referred to above. The threaded member could be manually or mechanically rotated as required. The base of the bar 4 would be adapted for sliding movement track in the base 2 allowing it to move readily but in a constrained manner, as to direction, relative to the base 2. The engagement of the bar base in the track and the physical strength of the bar 4 would need to be such that it could resist the leverage that would be applied to the bar 4 at its unsupported upper end during the stretching of the bag, this is however a matter of mechanical design and not an inventive aspect of the apparatus of the invention.

The foregoing descriptions have been based on a "pull to stretch" concept. In a variation the stretch can be achieved by rotating a slotted member, see FIG. 18 which is a top view of a slotted mast 20 with the plastic film 8 inserted in the slot. After the positioning of the members 7 to provide a throat through which the bag can be moved in a tensioning operation (see FIG. 19) a number of turns applied to the mast 20 (see FIG. 20) would be sufficient to achieve the stretch required in the plastic around the payload and then securement is achieved by a heat seal or a clip pair or by stapling.

Many mechanisms may be devised for the rotation of the mast 20, for example only, a worm and worm wheel gear arrangement may be provided or a ratchet arrangement of well known form may be used. These arrangements have the advantage that once the effort needed to rotate the mast 20 is discontinued the tension is maintained in the bag by the action of the ratchet or by the non-reversible characteristics of a worm and worm wheel arrangement. The rotation of the mast 20 could be mechanically or manually achieved. After the securement of the plastic the mast 20 could be unwound sufficiently to allow the plastic thereon to be severed from that around the article.

In an alternative the sleeve of plastic film could be replaced by a strip of plastic film and the two ends of the strip could be introduced into the slot of the mast 20. Once the mast had been turned one or two times to provide a grip of the plastic on the mast the above procedure could be performed. The disadvantage with this arrangement is that with a bag an end cover for the load is automatically provided. This shortcoming could however be overcome by placing a sheet of plastic film over the top of the load so it hangs down over the sides of the load and then by using a strip as proposed a total cover could be provided as before.

In the case of heat sealing or in other operations the members 7 could be moved sequentially. For example, one member 7 could be moved to its final innermost location and the other member 7 could be moved to an initial location closely adjacent the first member 7 and then after the stretch is applied to the plastic a final small movement of the second member 7 towards the first member 7 could be provided to finalise the securement of the plastic.

It is to be noted that the foregoing description has used loaded pallets as illustrative examples. In practice there is very little limitation on the nature of the loads that can be "wrapped" by the devices disclosed and by the method of the invention. Large loads, such as a number of loaded pallets, or stacked cartons or other like loads on a platform or other support could be "wrapped" if a large enough bag or long enough strip of plastic film is available. Wrapping of a load on a truck top could be readily achieved, for example, by the use of a device or devices as disclosed mounted on a mobile support, e.g. a fork lift truck. For this reason the invention is not to be considered as limited to the applications or to the forms of apparatus as disclosed but is to be seen as providing a novel concept in wrapping.

What is claimed:

1. A method of forming a tight wrapping around an upstanding assembly of articles hereinafter called a load by the steps of:

(a) providing a wrapping device comprised of a load positioning station, a wrapping material storage station above the load positioning station, a wrap tensioning means and a heat sealing means, (b) providing a roll of elastically stretchable plastic film material in tube form mounted at the material storage station the tube having an internal unstretched circumferential dimension when open which is sufficiently large to allow the tube to be passed vertically down over the load to be wrapped and over an upstanding movable pressure applying mast means spaced from the load means forming part of the wrap tensioning means, (c) providing a loose wrap for the load by passing the tube down over the load and the mast means so they both lie within the tube, (d) severing the wrap from the roll of film material, (e) gripping the wrap with the mast means and moving the mast means relative to the load to induce initial circumferential tension in the wrap and form a pair of tensioned panels of material that extend between the load and the mast means and which converge from the load to the mast means, (f) applying forces to both panels to cause them both to move arcuately into engagement closely adjacent the load to induce further circumferential tension in said wrap, and (g) sealing the panels together adjacent said load.

2. A method as claimed in claim 1 wherein the mast is moved rectilinearly away from the load positioning station.

3. A method as claimed in claim 1 wherein the mast is moved rotationally.

4. Apparatus to wrap an article or a group of articles, hereinafter called a load, the apparatus comprising a base including a load positioning station, a wrapping material storage station above the load positioning station, a tensioning means including a mast mounted on the base and movable relative to the base to induce initial circumferential tension in a tube of elastically stretchable plastic film material extending around a major part of the load and attached to the mast with two panels of film material extending from the load to the mast and which converge towards the mast, further tensioning means to apply them into contact adjacent the load, and sealing means to seal the panels together adjacent the load and between the load and the further tensioning means.

5. Apparatus as claimed in claim 4 wherein the mast moves rectilinearly on the base.

6. Apparatus as claimed in claim 4 wherein the mast moves rotationally on the base.

7. Apparatus as claimed in claim 4 wherein the further tensioning means comprises two arcuately movable arm assemblies mounted on the base.

8. Apparatus as claimed in claim 4 wherein the further tensioning means comprises two linearly movable arm assemblies mounted on the base.

* * * * *